United States Patent [19]

Hartwich et al.

[11] 4,434,713

[45] Mar. 6, 1984

[54] CALENDER

[75] Inventors: Gerhard Hartwich; Josef Pav, both of Krefeld; Dieter Preuss, Kaarst, all of Fed. Rep. of Germany

[73] Assignee: Kleinewefers GmbH, Krefeld, Fed. Rep. of Germany

[21] Appl. No.: 323,095

[22] Filed: Nov. 19, 1981

[30] Foreign Application Priority Data

Nov. 21, 1980 [DE] Fed. Rep. of Germany ..... 3043901

[51] Int. Cl.[3] ..... B30B 3/04

[52] U.S. Cl. ..... 100/168; 100/170

[58] Field of Search ..... 100/161, 168, 169, 170, 100/47

[56] References Cited

U.S. PATENT DOCUMENTS

| | | | |
|---|---|---|---|
| 2,479,759 | 8/1949 | Merchant | 100/170 X |
| 3,111,047 | 11/1963 | Metzger | 100/170 X |
| 3,159,063 | 12/1964 | Fox | 100/170 X |
| 4,311,091 | 1/1982 | Pav et al. | 100/170 X |

FOREIGN PATENT DOCUMENTS

| | | | |
|---|---|---|---|
| 1102690 | 9/1957 | Fed. Rep. of Germany | 100/168 |

*Primary Examiner*—Peter Feldman

*Attorney, Agent, or Firm*—Kontler, Grimes & Battersby

[57] ABSTRACT

A calender wherein the bearings for the end portions of the uppermost roll carry pressure transducers in the form of inflatable plenum chambers or hydraulic cylinder and piston units operable to bear against the lower end faces of vertical feed screws which are axially movably mounted in the support to move the bearings through distances of up to 800 mm. The pressure transducers can shift the bearings for the uppermost roll through distances of up to 25 mm, and they are movable transversely of the respective feed screws or vice versa to compensate for manufacturing tolerances, wear and/or unequal stresses. The lowermost roll is normally held at a predetermined level by a pair of fluid-operated motors which urge the respective bearings against the undersides of stops provided therefor on the support.

17 Claims, 3 Drawing Figures

CALENDER

CROSS-REFERENCE TO RELATED CASES

Applicants and their U.S. attorneys are aware of the following commonly owned U.S. patents and/or patent applications which deal with calenders including component parts resembling certain parts of the calender of the present invention; U.S. Pat. No. 4,290,351 granted Sept. 22, 1981 to Josef Pav et al.; Ser. No. 054,614 filed July 3, 1979 by Josef Pav et al.; Ser. No. 230,022 filed Jan. 30, 1981 by Josef Pav et al.; Ser. No. 230,672 filed Feb. 2, 1981 by Josef Pav.; and Ser. No. 232,197 filed Feb. 6, 1981 by Josef Pav et al. Applicants and their .S. attorneys are further aware of the disclosure in commonly owned published German patent application Ser. No. 24 50 717 filed Oct. 25, 1974 and of the disclosure in commonly owned published Geman patent application Ser. No. 24 52 977 filed Nov. 8, 1974.

BACKGROUND OF THE INVENTION

The present invention relates to calenders in general, and more particularly to improvements in means for mounting and moving the uppermost roll of a stack of superjacent rolls in a machine for calendering webs of paper, textile material or the like.

It is already known to mount the bearings for the end portions of the lowermost calender roll on hydraulic motors which maintain such bearings in abutment with the undersides of suitable stops on the frame or support of the calender. It is further known to employ upright feed screws which can move the bearings for the end portions of the uppermost roll downwardly so that the uppermost roll can bear against the roll therebelow with a pressure which is required for proper treatment of the running web. For example, U.S. Pat. No. 2,861,504 granted Nov. 25, 1958 to Kane discloses a calender wherein the lower end portions of the feed screws are connected with the bearings for the uppermost roll. The feed screws serve to adjust the position of the uppermost roll in order to compensate for reductions of roll diameters as a result of wear upon and surface treatment of such rolls. Furthermore, the feed screws select the pressure with which the neighboring rolls bear against each other so that the web which is advanced through the nips of the rolls is subjected to requisite smoothing, satinizing or other treatment. It has been found that such construction does not allow for accurate adjustment of the uppermost roll with reference to the support and/or with reference to the roll or rolls therebelow.

U.S. Pat. No. 3,364,848 granted Jan. 23, 1968 to Müller discloses a paper satinizing calender wherein the bearings for the end portions of the uppermost roll are biased downwardly by the piston rods of double-acting hydraulic cylinder and piston units. The cylinders are mounted on the support at a level above the uppermost roll. The piston rods perform the functions of the aforementioned feed screws, namely, to compensate for a reduction of the diameter of each surface-treated roll as well as to apply the necessary pressure to the web which travels through the nips of neighboring rolls. A drawback of the machine which is disclosed in the patent to Müller is that the strokes of the piston rods are quite substantial, often in the range of up to 800 mm if the calender comprises a substantial number of rolls. Consequently, if the lower end portions of extended piston rods are subjected to pronounced transverse (substantially horizontal) stresses which tend to move the piston rods out of axial alignment with the respective cylinders, the pistons at the upper ends of the piston rods are likely to jam in the cylinders and the piston rods are likely to apply substantial forces to their guide means which are installed at the lower ends of the associated cylinders. The aforementioned transverse stresses can develop for a variety of reasons, for example, due to tolerances in the machining of guide means for the bearings of the uppermost roll and/or due to unavoidable vibrations which develop when the calender is in use. Such stressing of the lower end portions of the piston rods entails pronounced wear upon the cylinders, upon the piston, upon the surfaces of the piston rods and upon the sealing means therefor as well as undesirable instability of the respective bearings. As the wear progresses, the rate at which the hydraulic fluid escapes from the cylinders increases and the leaking fluid is likely to contaminate parts of the machine as well as the running web. In order to eliminate or repair the resulting damage, the calender must be arrested at frequent intervals and for extended periods of time with attendant pronounced losses in output. Attempts to reduce leakage by resorting to complex and numerous sealing elements have met with minimal success. In fact, the provision of more elaborate and/or additional seals entails an increase in frictional forces which prevent accurate adjustment of the forces with which the rolls bear against the running web when the calender is in use. Furthermore, the just mentioned frictional forces are not identical at both ends of the uppermost roll and/or their magnitude varies with changes in the level of the uppermost roll so that the machine does not allow for predictable and reproducible selection of forces which are applied to the treated material.

OBJECTS AND SUMMARY OF THE INVENTION

An object of the invention is to provide a calender wherein the uppermost roll of a battery of superjacent rolls is adjustably mounted in a novel and improved way.

Another object of the invention is to provide a calender wherein the positions of the uppermost roll with reference to the roll or rolls therebelow can be selected with a degree of accuracy and reproducibility which cannot be matched in heretofore known calendering machines.

A further object of the invention is to provide the calender with novel and improved means for moving the bearings for the end portions of the uppermost roll through identical increments and without the danger of contaminating the machine and/or the treated material.

An additional object of the invention is to provide a calender wherein the wear upon component parts which serve to move the uppermost roll relative to the roll or rolls therebelow is a fraction of the wear upon such parts in conventional calenders.

Still another object of the invention is to provide a calender wherein the stability of means for supporting and moving the uppermost roll is incomparably higher than in heretofore known calenders and wherein the extent of displacement of the uppermost roll does not appreciably influence the orientation of such roll.

A further object of the invention is to provide novel and improved means for effecting precise adjustments of the position of the uppermost roll with reference to the adjacent roll or rolls of a calender.

Another object of the invention is to provide a calender wherein vibrations and/or the absence of accurate machining cannot appreciably influence the position of the uppermost roll with reference to the other roll or rolls.

An additional object of the invention is to provide a calender wherein the quantity of hydraulic fluid which is used to effect accurate adjustments of the uppermost roll is a small fraction of the quantity which is needed in heretofore known calenders with hydraulically operated means for moving the uppermost roll.

An ancillary object of the invention is to provide a calender wherein the wear upon the sealing elements in the means for moving the uppermost roll is a minute fraction of the wear upon such elements in heretofore known calenders.

Another object of the invention is to provide a calender which exhibits the above-enumerated features and advantages even though its overall design need not appreciably deviate from that of heretofore known calenders.

A further object of the invention is to provide the calender with novel and improved means for moving the bearings for the uppermost roll with reference to those devices or motors which effect coarse and relatively large adjustments in the position of such roll with reference to the support and the other roll or rolls of the machine.

The invention is embodied in a calender which comprises a support, a plurality of superjacent (preferably horizontal) rolls adjacent to the support and including a lowermost and an uppermost roll, first and second bearings for the first and second end portions of each roll, guide means provided on the support for the bearings (such guide means can comprise first and second upright suspended spindles provided on the support for the respective bearings of each roll above the lowermost roll and means for limiting the extent of downward movement of the bearings along the respective spindles), means for normally maintaining the bearings for the end portions of the lowermost roll at a predetermined level (such means can comprise stops provided on the support and serving as abutments for the bearings for the end portions of the lowermost roll, and fluid-operated motor means, e.g., single-acting hydraulic cylinder and piston units, for urging the bearings for the end portions of the lowermost roll upwardly against the respective stops), first and second mechanical displacing means for moving the respective bearings for the end portions of the uppermost roll downwardly through a first range of distances (e.g., between 500 and 800 mm), and first and second pressure transducer means interposed between the respective bearings for the end portions of the uppermost roll and the respective displacing means and being operative to move the uppermost roll downwardly through a second range of distances (e.g., 2 to 25 mm) which is a small and preferably a minute fraction (e.g., one or two percent) of the first range. As a rule, the upper limit of the second range need not exceed 25 mm and is normally less than 10 mm.

Each mechanical displacing means can comprise a rack and pinion drive but preferably a vertical feed screw which is axially movably mounted in the support, a nut meshing with the feed screw and rotatably mounted in the support, and motor means for rotating the nut clockwise or counterclockwise to thereby move the feed screw up or down.

Each pressure transducer means can comprise a fluid-operated (preferably hydraulic) cylinder and piston unit which is preferably but need not be of the double-acting type. Each unit can comprise a cylinder mounted in the respective bearing for an end portion of the uppermost roll and a piston which is reciprocable in the cylinder into and from engagement with the respective displacing means. Each cylinder can constitute an integral part of the respective bearing for an end portion of the uppermost roll or a separate component which is installed in the respective bearing, for example, in a socket provided therefor in the upper end face or side of the respective bearing. The upper portions of the pistons can be provided with flat upper end faces or surfaces extending at right angles to the direction of movement of the pistons and abutting against complementary surfaces or end faces at the lower ends of the feed screws of the respective displacing means in response to admission of a pressurized fluid into the corresponding cylinders.

Alternatively, each pressure transducer means can comprise a cell constituting a plenum chamber and having a wall portion which is deformable in response to admission of a pressurized fluid into the chamber to thereby increase the distance between the respective bearing for an end portion of the uppermost roll and the respective displacing means. The deformable wall portions of the cells are adjacent to the aforementioned lower end faces or surfaces of the respective feed screws.

The novel features which are considered as characteristic of the invention are set forth in particular in the appended claims. The improved calender itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
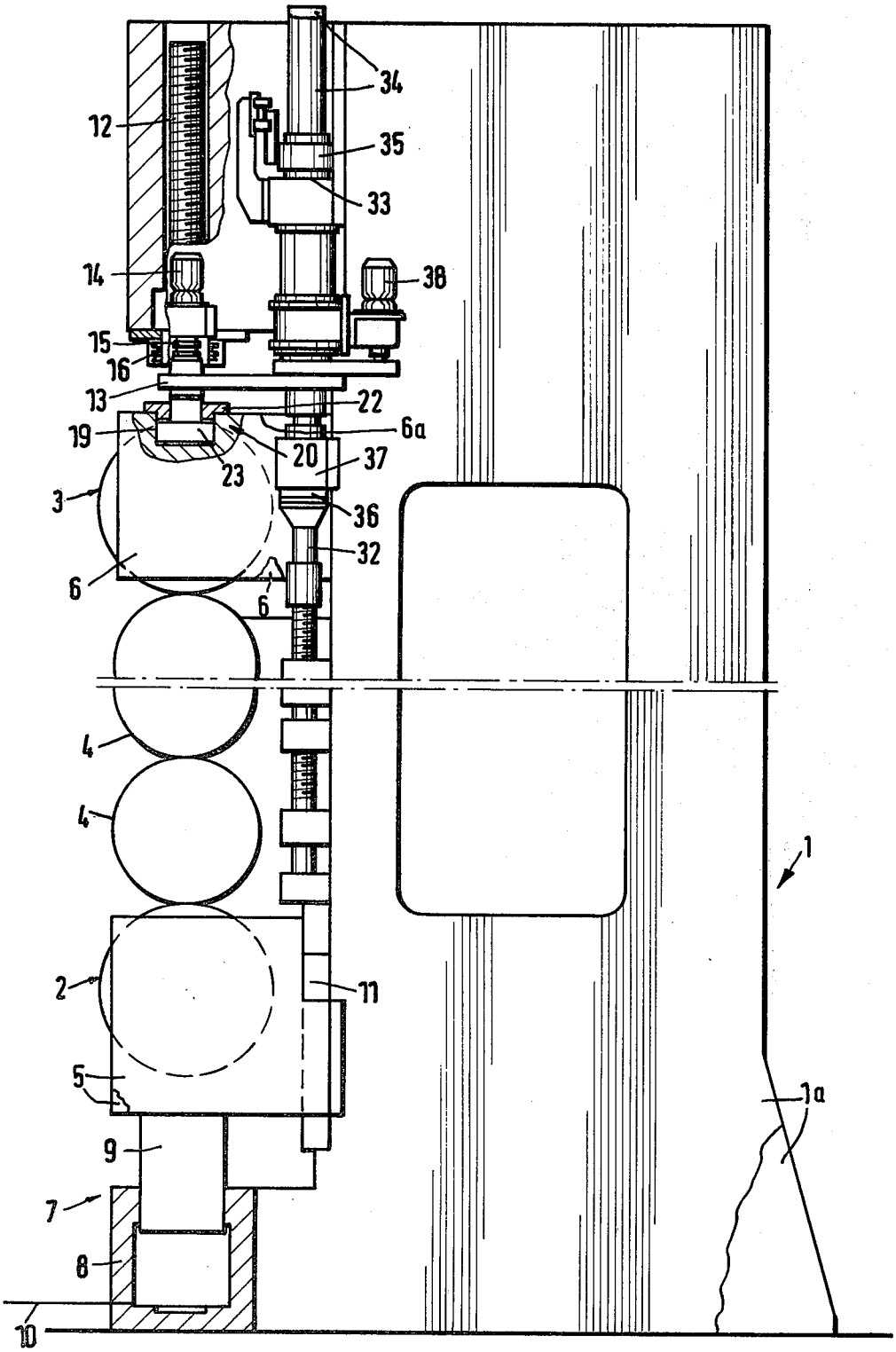
FIG. 1 is a somewhat schematic partly side elevational and partly vertical sectional view of a calender which embodies one form of the invention and wherein the pressure transducer means include portions which are integral with the respective bearings for the end portions of the uppermost roll.

FIG. 1 illustrates a calender having a support 1 which includes two spaced parallel upright sections 1*a*. The support 1 indirectly carries a plurality of superjacent horizontal calender rolls including a lowermost roll 2, an uppermost roll 3 and one or more intermediate rolls 4. For example, the calender can comprise a total of twelve rolls. The two end portions of the lowermost roll 2 are mounted in discrete bearings 5, and the two end portions of the uppermost roll 3 are mounted in discrete bearings 6. The bearings for the end portions of the intermediate rolls 4 have been omitted for the sake of clarity. Each of the sections 1*a* supports one bearing 5, one bearing 6 and one bearing for each of the intermediate rolls 4.

The means for maintaining the bearings 5 for the lowermost roll 2 at a predetermined level when the calender is in use comprises two stops 11 which are mounted on or integrally formed with the respective sections 1*a* of the support 1 and two hydraulic motors 7 which urge the bearings 5 upwardly against the undersides of the respective stops 11. Only one of the stops 11 and only one of the motors 7 is shown in FIG. 1. Each of these motors comprises a cylinder 8 which is rigid with the support 1, a piston 9 which is reciprocable in the cylinder 8 and can bear against the underside of the respective bearing 5, and conduit means 10 for connecting the chamber of the cylinder 8 with a suitable source (not shown) of pressurized hydraulic fluid. The piston 9 descends by gravity and under the weight of the respective bearing 5 when the valve means (not shown) permits fluid to escape from the cylinder 8 via conduit means 10.

The mechanical displacing means for the bearings 6 at the ends of the uppermost roll 3 comprise discrete vertical feed screws 12 which are non-rotatably but axially movably mounted in the respective sections 1*a* of the support 1 at a level above the uppermost roll 3. A bracket 13 on each section 1*a* guides the lower portion of the respective feed screw 12, and each feed screw 12 meshes with a nut 17 which is rotatably mounted in the corresponding section 1*a*. The means for rotating the nuts 17 to thereby move the corresponding feed screws 12 up or down comprises reversible electric motors 14 and gear trains including spur gears 15, 16. The lower end faces or surfaces 18 of the feed screws 12 are flat or substantially flat and extend at right angles to the axes of the respective feed screws.

Each bearing 6 supports a pressure transducer 20 which constitutes a single-acting or double-acting cylinder and piston unit serving to move the respective bearing 6 downwardly with reference to the corresponding feed screw 12. The upper side 6*a* of each bearing 6 is formed with a socket or recess 19 which is the chamber of the cylinder of the respective transducer 20, i.e., each of these transducers includes a cylinder which is an integral part of the corresponding bearing 6. The pistons 23 of the transducers 20 are reciprocable in the respective sockets 19 and their upper portions 24 (see FIG. 2) extend upwardly through apertured covers or lids 22 which are secured to the bearings 6 to overlie and seal the respective sockets 19. The upper end faces or surfaces 25 of the piston portions 24 are flat and at least substantially parallel to the end faces 18 of the respective feed screws 12. The upper chamber 26 of each cylinder can receive pressurized fluid via conduit means 27 to move the corresponding piston 23 downwardly (i.e., to move the end face 25 away from the adjacent end face 18), and the lower chamber 28 of each cylinder can receive pressurized fluid via conduit means 29 to move the piston 23 upwardly and to thereby cause the end face 25 to bear against the adjacent end face 18. The larger-diameter lower portion of each piston 23 has one or more circumferential grooves for sealing rings 31. Additional sealing rings 30 are recessed into the internal surface of the cover 22 to engage the external surface of the piston portion 24.

Figure 2:
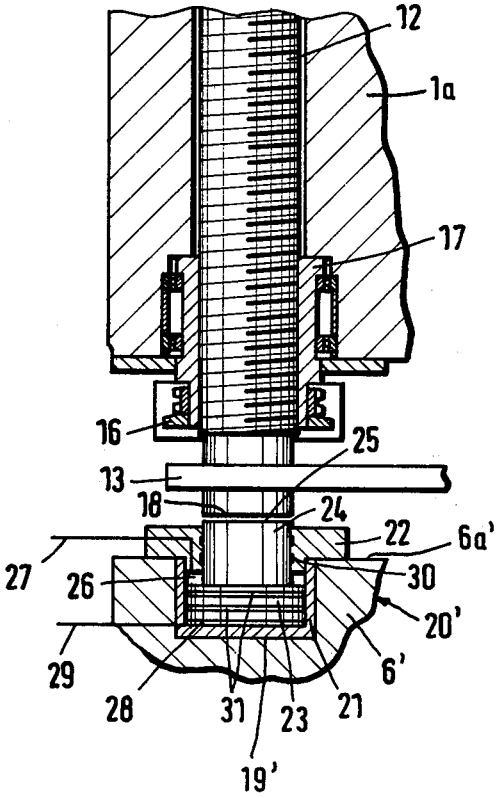
FIG. 2 is an enlarged fragmentary vertical sectional view of a modified calender wherein the pressure transducer means have portions which are not integral with the respective bearings.

The embodiment of FIG. 2 differs from the embodiment of FIG. 1 solely in that the cylinder 21 of the pressure transducer 20' is a separately produced piece which is inserted into the socket 19' in the upper side or end face 6*a'* of the corresponding bearing 6' for an end portion of the uppermost calender roll.

Referring again to FIG. 1, the sections 1*a* of the support 1 mount discrete upright suspended spindles 32 for the corresponding bearings of all rolls (3 and 4) above the lowermost roll 2. The upper end portion 34 of each spindle 32 meshes with a nut 35 which rests on an abutment 33 of the respective section 1*a*. The purpose of the spindles 32 is to determine the positions of rests for the rolls 3 and 4. Each spindle 32 further carries an abutment 36 for an extension 37 of the respective bearing 6. The abutments 36 can be moved up and down with respect to the corresponding spindles 32 by discrete motors 38. The manner in which the spindles 32 support or carry supports for the bearings of the intermediate rolls 4 is known and forms no part of the present invention; therefore, the supports for the bearings of the rolls 4 are not shown in FIG. 1.

It will be noted that the diameter of the cylinder in a pressure transducer 20 or 20' can exceed the diameter of the adjacent feed screw 12. On the other hand, the diameter of the upper portion 24 of each piston 23 can match or closely approximate the diameter of the adjacent feed screw 12. There is ample room in each bearing 6 or 6' for a relatively large-diameter cylinder, especially since the axial length of each cylinder need not be pronounced because the maximum stroke of a piston 23 can be less than 25 mm.

While it is possible to employ pressure transducers in the form of single-acting cylinder and piston units, double-acting units are preferred at this time because the lower chambers (28) receive pressurized fluid to ensure the application of requisite pressure to the uppermost roll 3 and the upper chambers (26) receive pressurized fluid in order to effect immediate segregation of end faces 25 from the complementary end faces 18, e.g., to overcome frictional engagement between such end faces when the operators wish to rapidly lower the pistons 23 preparatory to lifting of the feed screws 12 through the medium of the motors 14, nuts 17 and gear trains 15, 16.

The uppermost roll 3 (or any of the battery or rolls 2, 3 and 4) can be solid cylindrical body or an elongated hollow sleeve which is flexible and is rotatably mounted on a stationary carrier or shaft which extends through its axial bore. Reference may be had, for example, to the commonly owned U.S. Pat. No. 4,290,353 granted Sept. 22, 1981 to Josef Pav et al.

When the rolls 2, 3 and 4 are reinserted into the support 1 after a treatment of their surfaces, the chambers of the two cylinders 8 receive pressurized hydraulic fluid via conduit means 10 so that the motors 7 lift the respective bearings 5 for the end portions of the lowermost roll 2 against the undersides of the corresponding stops 11. In the next step, the feed screws 12 are moved downwardly by appropriate selection of the direction of rotation of the reversible motors 14 so that the lower end faces 18 of the feed screws 12 move close to the upper end faces 25 of the adjacent pistons 23. The desired or required force with which the uppermost roll 3 is to bear against the nearest intermediate roll 4 is thereupon selected by admitting pressurized fluid into the lower cylinder chambers 28 by way of the corresponding conduit means 29 so that the pistons 23 rise and move their end faces 25 against the adjacent end faces 18 of the aligned or substantially aligned feed screws 12. The two bearings 6 are then form-lockingly and highly reliably coupled to the corresponding sections 1*a* of the support 1 via mechanical displacing means including the feed screws 12 and nuts 14.

Since the axial length of each piston 23 is only a small fraction of the axial length of a feed screw 12 or the axial length of a piston in the aforediscussed patent to Müller, the forces which act upon the exposed portions of the pistons 23 in directions at right angles to the axes of the feed screws 12 cannot cause appreciable misalignment of such pistons in their respective cylinders. The transverse stresses develop primarily as a result of vibrations when the calender is in use. Eventual tolerances in the machining of component parts of the displacing means (e.g., tolerances in machining of the feed screws 12 and the associated nuts 17) and/or tolerances in machining of the guide means for the bearings 6 cannot affect the orientation of the pistons 23 since such pistons are free to move laterally of the adjacent spindles 12 at any time when their end faces 25 do not actually bear against the corresponding end faces 18. In other words, machining tolerances cannot affect the magnitude and/or cause the generation of transverse stresses upon the pistons 23 because these pistons are not positively coupled to the corresponding sections 1*a* and indirectly engage the sections 1*a* only when their end faces 25 bear against the end faces 18 of the adjacent feed screws 12. Any adjustments in positions of the pistons 23 with reference to the adjacent feed screws 12 as a result of inaccurate machining of component parts of the pressure transducers, displacing means and/or guide means for the bearings 6 take place before the pistons engage the corresponding feed screws. Therefore, the wear upon the sealing elements 30 and/or 31 is a minute fraction of wear upon such sealing elements in conventional calenders, and the relatively small quantities of hydraulic fluid which are used to operate the pressure transducers 20 or 20' are highly unlikely to spill into the machine and/or onto the web advancing through the nips of neighboring rolls.

The motors 7 are actuated to lower the bearings 5 for the end portions of the lowermost roll 2 when the web breaks, i.e., to increase the width of the gaps between neighboring rolls, as well as to facilitate the removal of rolls preparatory to inspection and/or surface treatment.

Figure 3:
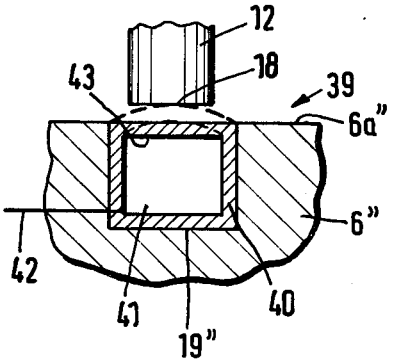
FIG. 3 is a fragmentary vertical sectional view of a third calender wherein the pressure transducer means constitute plenum chambers with deformable wall portions.

FIG. 3 illustrates a modified pressure transducer 39 which can be used in lieu of a pressure transducer 20 or 20'. The transducer 39 is a cell or plenum chamber having a closed housing or casing 40 which is recessed into the socket 19" provided in the upper side or end face 6*a*" of the respective bearing 6". The internal space 41 of the plenum chamber can receive pressurized hydraulic fluid via conduit means 42, and the top wall portion 43 of the housing 40 is elastically deformable in response to admission of pressurized fluid into the space 41 so that the wall portion 43 bulges upwardly (as indicated by phantom lines) and its exposed upper side bears against the lower end face 18 of the corresponding feed screw 12.

An advantage of pressure transducers of the type shown in FIG. 3 is that they do not require any seals and are practically or entirely leakproof. Moreover, they are simpler than double-acting cylinder and piston units because the wall portion 43 need not be returned to its solid-line undeformed position; all that is necessary to render the pressure transducer 39 inoperative is to permit pressurized fluid to escape from the space 41 via conduit means 42. The solid-line position is the normal (unstressed) position of the wall portion 43. The transducer 39 need not have any discrete moving parts, i.e., the wall portion 43 is movable with reference to but is integral with the remaining wall portions of the housing 40. The extent of deformation of the wall portion 43 can be regulated with a very high degree of accuracy, i.e., the operators or an automatic control unit can readily select the desired strokes of the deformable wall portion 43 and hence the force with which the wall portion 43 bears against the end face 18 of the adjacent feed screw 12 to effect the application of requisite pressure against the corresponding bearing 6" for an end portion of the uppermost roll.

Another advantage of the pressure transducer 39 is that the wear upon its parts is practically nil or only a minute fraction of the wear upon pressure transducers wherein one or more discrete parts must or can move with reference to one or more stationary parts. However, the wear upon cylinder and piston units of the type shown at 20 or 20' is also acceptable and is sufficiently small to permit uninterrupted use of such transducers for long periods of time.

An important advantage of the improved calender is that the feed screws 12 can be readily designed to effect the displacements of the bearings for the uppermost roll through distances which are needed in a multiple-roll calender in order to compensate for wear and/or surface treatment of the elastic rolls. Since the long-distance movements of the bearings for the uppermost roll are preferably effected by mechanical displacing means, the likelihood of contamination of the machine and/or running web by oil or another hydraulic fluid is practically nil, especially since the fluid consumption of the relatively small pressure transducers is a minute fraction of the fluid requirements of displacing means in conventional calenders wherein each and every movement of each of the bearings for the end portions of the uppermost roll is effected by hydraulic motors. The pressure transducers are used solely to effect accurate selection of required forces acting upon the uppermost roll 3 and hence upon the web which travels through the nips of the rolls. The uppermost roll 2 bears against the nearest intermediate roll 4, such intermediate roll bears against the roll therebelow, and so forth. As mentioned above, any transverse forces which act upon the upper end portions of the pistons 23 (e.g., as a result of vibrations) are minute fractions of forces which develop in conventional machines with long piston rods for the bearings which carry the end portions of the uppermost roll, and machining tolerances of component parts of the displacing means, pressure transducers and/or guide means for the uppermost bearings cannot cause any stressing of the pistons 23 because such pistons are not positively connected with the feed screws 12. The likelihood of adverse effects of transverse stresses upon pressure transducers of the type shown in FIG. 3 is even more remote. Therefore, the seals (if any) can last for long period of time and the maintenance cost of the machine is reduced accordingly. Furthermore, not only is the fluid unlikely to contaminate the treated material but such fluid is also unlikely to deposit on component parts of the calender so that such parts are less prone to gather and retain lint, dust and/or other impurities when the machine is in use.

Another important advantage of the improved calender is that the feed screws 12 can be moved up or down by relatively small motors 14. This is due to the fact that the lower end portions of the feed screws 12 need not carry the bearings for the end portions of the uppermost roll, i.e., such feed screws need not carry a substantial load which includes the weight of the uppermost roll. Furthermore, each feed screw 12 can be rapidly moved to the selected axial position so that its lower end face 18 is close or very close to the piston or deformable wall portion of the corresponding pressure transducer. As mentioned above, the feature that the feed screws 12 need not be positively connected with the bearings for the end portions of the uppermost roll further ensures that the machine automatically compensates for any tolerances in the region of the pressure transducers because the pressure transducers can move transversely of the associated feed screws and/or vice versa at any time except when they engage the lower end faces of the feed screws.

The mounting of pressure transducers in the bearings for the end portions of the uppermost roll is desirable and advantageous. Such bearings are relatively bulky so that there is ample room for installation of the pressure transducers in or on these bearings. As mentioned above, at least a portion of each transducer is preferably recessed into a socket in the upper side of the corresponding bearing for the uppermost roll 3. This reduces the space requirements of the pressure transducers and protects their component parts from damage and/or contamination. Even though it would be possible to install the pressure transducers in or on the feed screws 12, the mounting of such transducers on the bearings for the end portions of the uppermost roll is preferred at this time for the aforementioned reasons as well as on the additional ground that the chambers or spaces of the pressure transducers would have to be connected with the source of pressurized fluid by relatively long conduits if the transducers were mounted at the lower ends of the feed screws 12.

The distance between the lower and upper end positions of each feed screw 12 can be in the range of 500 to 800 mm, depending on the number of rolls in the calender. On the other hand, the distance between the upper and lower end positions of the end face 25 of a piston 23 or between the upper and lower end positions of the upper side of the deformable wall portion 43 of a transducer 39 need not exceed 25 mm and is normally less than 10 mm. In many instances, a stroke of 2–3 mm suffices to ensure proper engagement between the piston or wall portion of a pressure transducer and the end face 18 of the adjacent feed screw 12. Thus, the stroke of the piston or deformable wall portion need not amount to more than one or two percent of the maximum stroke of a feed screw 12.

An advantage of the suspension spindles 32 is that they carry the bearings for the rolls 3 and 4, i.e., the feed screws 12 need not support the bearings and the uppermost roll 2. However, it is equally within the purview of the invention to provide other types of guide means and/or supporting means for the bearings 6, 6' or 6''. For example, such bearings can come to rest on platforms or like carriers which are adjustably mounted on the respective sections 1*a* of the support 1.

It is also possible to replace the illustrated or other mechanical displacing means for the bearings 6, 6' or 6'' with fluid-operated displacing means. This would not greatly increase the risk of leakage because the seals for the fluid-operated displacing means would be subject to minimal wear since the pressure transducers would engage the pistons or piston rods of such displacing means only after the displacing means have completed their downward strokes and in response to admission of pressurized fluid into the chambers or spaces of the transducers.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A calender comprising a support; a plurality of superjacent rolls having first and second end portions, adjacent to said support and including a lowermost and an uppermost roll; first and second bearings for the respective end portions of said rolls; guide means provided for said bearings on said support; means for normally maintaining the bearings for said lowermost roll at a predetermined level; first and second displacing means for moving the respective bearings for said uppermost roll downwardly through a first range of distances; and first and second pressure transducer means interposed between the respective bearings for said uppermost roll and the respective displacing means and operative to move said uppermost roll downwardly, while said displacing means is idle, through a second range of distances which is a small fraction of said first range.

2. The calender of claim 1, wherein the upper limit of said second range of distances is 25 mm.

3. The calender of claim 1, wherein the upper limit of said second range of distances is 10 mm.

4. The calender of claim 1, wherein each of said pressure transducer means comprises a fluid-operated cylinder and piston unit.

5. The calender of claim 4, wherein each of said units comprises a cylinder provided in the respective bearing for the uppermost roll and a piston reciprocable in the corresponding cylinder into and from engagement with the respective displacing means.

6. The calender of claim 5, wherein each of said displacing means comprises a feed screw axially movably installed in said support and having a lower end face, each of said pistons having an upper end face movable into abutment with the lower end face of the respective feed screw in response to admission of a pressurized fluid into the respective cylinder.

7. The calender of claim 4, wherein each of said units is a double-acting cylinder and piston unit.

8. The calender of claim 1, wherein each of said pressure transducer means comprises a plenum chamber having a wall portion which is deformable in response to admission of a pressurized fluid into the chamber to thereby increase the distance between the respective bearing for the uppermost roll and the respective displacing means.

9. The calender of claim 8, wherein each of said displacing means comprises a feed screw vertically movably installed in said support and having a lower end face, the deformable wall portions of said plenum chambers being adjacent to the end faces of the respective feed screws.

10. The calender of claim 1, wherein said guide means comprises first and second upright suspended spindles provided on said support for the respective bearings of each roll above said lowermost roll and means for limiting the extent of downward movement of said bearings along the respective spindles.

11. The calender of claim 1, wherein each of said pressure transducer means has a first surface extending substantially transversely of the direction of downward movement of said uppermost roll and each of said displacing means has a second surface complementary to the respective first surface, said first surfaces abutting against the respective second surfaces on operation of said pressure transducer means to move said uppermost roll downwardly.

12. The calender of claim 11, wherein each of said pressure transducer means comprises a portion which is rigid with the respective bearing for the uppermost roll, each of said displacing means comprising an upright feed screw vertically movably installed in said support and having a lower end face which constitutes the respective second surface.

13. The calender of claim 1, wherein each bearing for said uppermost roll has an upper side and a socket in such upper side, at least a portion of each of said pressure transducer means being disposed in the respective socket.

14. The calender of claim 1, wherein said maintaining means comprises stops provided on said support for the bearings for said lowermost roll and fluid-operated motor means for urging the bearings for said lowermost roll upwardly and against the respective stops.

15. The calender of claim 1, wherein each of said displacing means comprises an upright feed screw non-rotatably and axially movably mounted in said support, a nut rotatably mounted in said support and meshing with the respective feed screw, and motor means for rotating said nuts clockwise or counterclockwise to thereby move the respective feed screws up or down.

16. The calender of claim 15, wherein each of said pressure transducer means is interposed between the respective feed screw and the corresponding bearing for the uppermost roll.

17. The calender of claim 1, wherein said second range of distances is at most 2 percent of said first range.

* * * * *